US005570975A

United States Patent [19]

Reinert, Sr.

[11] Patent Number: 5,570,975

[45] Date of Patent: Nov. 5, 1996

[54] METAL FOUNDATION PUSH-IT AND INSTALLATION APPARATUS AND METHOD

[76] Inventor: Gary L. Reinert, Sr., 4319 Middle Rd., Allison Park, Pa. 15101

[21] Appl. No.: 266,183

[22] Filed: Jun. 27, 1994

[51] Int. Cl.[6] ..... E02D 7/00; E02D 17/02

[52] U.S. Cl. ..... 405/232; 173/184; 173/188; 175/171; 405/244; 405/229

[58] Field of Search ..... 405/232, 244, 405/231, 303, 229, 245–247; 175/162, 171; 173/184, 186, 187, 188, 193, 42, 44, 28, 26, 24

[56] References Cited

U.S. PATENT DOCUMENTS

| | | | |
|---|---|---|---|
| 2,285,889 | 6/1942 | Blanchard . | |
| 3,621,910 | 11/1971 | Sanford | 175/171 X |
| 3,864,923 | 2/1975 | Turzillo | 405/232 |
| 3,869,003 | 3/1975 | Yamada et al. | 405/232 |
| 4,193,459 | 3/1980 | Engstrom | 405/245 X |
| 4,296,821 | 10/1981 | Larson | 175/171 X |
| 4,626,138 | 12/1986 | Boyes | 405/232 |
| 4,637,758 | 1/1987 | Tamaki et al. | 405/248 |
| 4,809,788 | 3/1989 | Nelson | 173/42 X |
| 4,813,496 | 3/1989 | Rohweller et al. | 175/171 X |
| 5,018,905 | 5/1991 | Kinder | 405/230 |
| 5,104,264 | 4/1992 | Castagner et al. | 405/232 X |
| 5,145,286 | 9/1992 | Summers | 405/258 |
| 5,232,268 | 8/1993 | Dengler et al. | 173/184 X |
| 5,269,107 | 12/1993 | Klemm | 52/115 |

FOREIGN PATENT DOCUMENTS

| | | | |
|---|---|---|---|
| 0363044 | 10/1981 | Austria . | |
| 0794556 | 2/1936 | France . | |
| 2534292 | 4/1984 | France . | |
| 0089527 | 7/1980 | Japan | 405/232 |
| 0223217 | 9/1988 | Japan | 405/232 |
| 0223218 | 9/1988 | Japan | 405/232 |
| 0146015 | 6/1989 | Japan | 405/232 |
| 0260117 | 10/1989 | Japan | 405/232 |
| 0767285 | 9/1980 | U.S.S.R. | 405/254 |
| 0861476 | 9/1982 | U.S.S.R. | 405/232 |
| 2060742 | 5/1981 | United Kingdom . | |
| WO-A93/21393 | 10/1993 | WIPO . | |

*Primary Examiner*—Dennis L. Taylor
*Attorney, Agent, or Firm*—Douglas G. Glantz

[57] ABSTRACT

Mobile metal foundation installation apparatus and method are disclosed including a push-it carriage movably supported through controllable positioning to push a metal foundation into the ground by hydraulic cylinders pushing against a header frame held and secured in adjustable positions on a mobile tower. After the hydraulic cylinders extend to a maximum extension, the pushing reaction bar can be advanced to a lower position in the side frame of the tower. An auger is aligned below the push-it carriage to drill in advance of pushing the metal foundation into the ground in one step. Outboard satellite anchors hold down the mobile tower when the foundation is pushed into the ground. A second auger mounted and detachable on a crane drills holes for the outboard satellite anchors. The second auger can swing laterally to dig a left or right side outboard or satellite anchor hole. An extensible satellite anchor augering guide and anchor structural support extends and retracts on both sides of the mobile tower.

10 Claims, 6 Drawing Sheets

METAL FOUNDATION PUSH-IT AND INSTALLATION APPARATUS AND METHOD

BACKGROUND OF THE INVENTION

1. Field of the Invention

The present invention relates to structural foundations including earth anchors for supporting airport and roadway signs, utility poles, communication towers, and the like and installation apparatus and methods for such structural foundations.

2. Background

By conventional methods, a concrete foundation, also called a concrete pier or pad, is utilized for the installation of various types of structures, e.g., signs, high mast lighting and utility poles, communications towers, and the like. A concrete pad or pier is utilized for its mass to provide a structural foundation for supporting such structures.

These structures are attached to the concrete pier or pad by means of bolts or threaded anchors which are set to the required elevation in a rebar cage prior to pouring the concrete in forms.

In the installation of such a concrete pier or pad by the conventional method, site layout is performed, equipment is deployed, the site is excavated, the spoils are removed, and a stone sub-base sometimes is placed in the excavated hole. The work requires a backhoe, a truck, and equipment operators as well as the engineer and one or more laborers depending on the size of the job. Materials, such as the stone for the sub-base, are also required. In the case of some installations, e.g., in airport runway work, all construction debris and equipment must be removed from the work site by the end of each work day.

Then pouring forms are built, a rebar mat is installed, bolts or threaded anchors are attached to the rebar at the required elevation, and the concrete pad is poured. This work requires a carpenter, a laborer and the material, i.e., concrete, forms, test equipment, bolts, and rebar mats. Again, in the case of airport runway work, all construction debris and equipment must be removed from the site at the end of the work day.

Next, the forms must be stripped, and back-filling around the foundation takes place. This work requires a backhoe, the operator, a carpenter, a laborer, and materials used to back-fill and seed the area.

The conventional method requires the concrete to cure for about seven (7) days. This concrete curing sometimes takes longer depending on the type of concrete used. If testings show the concrete not to comply with a specified strength within the first seven (7) days, then it is required to wait twenty-eight (28) days before any structure can be installed upon the concrete.

Bolts or threaded anchors are used for the installation of structures on the foundation. The structures are installed after the concrete has cured. Accordingly, several days are required to install the concrete foundation and to place the structures into operation.

In the case of airport runway work, on the eleventh day, the concrete pad is drilled to provide holes for the installation of the concrete anchors. These concrete anchors are utilized for the installation of the anchor bolts which will be used for installing the airport runway sign upon the foundation. The sign then is installed and energized at this time through work performed by electricians. Accordingly, eleven days have been required to install and illuminate the airport runway sign.

From the description of the conventional method of installation for a structure supported by a concrete foundation, some of the major drawbacks of the conventional installation method are apparent. These drawbacks include prolonged roadway area closure time in the case of a roadway sign, utility pole, or high mast lighting pole, prolonged runway and taxiway closure time in the case of airport signs, and lengthy installation times. These drawbacks further include increased labor costs, weather dependent operation, and an increased risk of debris falling on the roadway or aircraft traffic areas (in the case of airport installations) attributable to the many truck trips required. These drawbacks and others are eliminated or substantially reduced by installing a metal sign or utility pole foundation.

INTRODUCTION TO THE INVENTION

The metal foundation is structurally and geotechnically engineered to provide the equivalent of a concrete foundation for each specific application. The metal foundation is completely coated with hot dip galvanizing for corrosion protection. For further protection in extremely corrosive soils, the metal foundations can be supplied as hot dip galvanized with an additional overall bituplastic coating. The metal foundation typically can include, e.g., in one embodiment, a length of standard schedule 40 pipe column with a number of longitudinal fins continuously welded to the entire length and to which a steel plate has been continuously welded to the top.

The metal foundation is installed by a simple, yet revolutionary method. The metal foundations are pressed into the soil, and no excavation is required.

On the same day, utilizing the metal foundation and installation method, a roadway or airport sign or utility pole, high mast lighting pole, or communications tower foundation can be set into the soil. The metal foundation provides a top plate upon which the structure can be installed. The foundation's top plate is pre-drilled to accept the structure's mounting bolts. The foundation is installed in the first hours of the work day, while in the later hours of the same work day, the structure is installed, wired, and energized. The installation requirements call for installation equipment, the metal foundation, and a crew of two pile drivers and one operator during the first hours of the work day, and electricians and materials in the final hours of the same day.

The metal foundation and installation method allow the entire installation to be performed in only one day, with one trip to the structure installation site. In the amount of time required to install one concrete foundation by the traditional method for airport sign foundations, eleven conventional metal foundations can be installed. In addition, all eleven foundations would have been installed at a lower cost and with a greater level of safety. Airfield closure time can be dramatically reduced.

Moreover, the metal foundation can be reused. If it becomes necessary to relocate a structure, the metal foundation can be removed and reinstalled at the new location. This removal and reinstallation provides not only a significant cost savings, but it removes any hazard associated with abandoned concrete piers or pads.

Metal foundations are engineered for specific applications. Some of these applications include high mast lighting poles, traffic lights, roadway sign or utility poles, airport signs, commercial signs and billboards, power distribution and communications towers, retaining walls, and many others.

The design of metal foundations is based on engineering calculations backed by independent, registered professional engineers and by extensive testing. For the calculations of the structural capacities, each foundation can be designed to take into consideration the geotechnical characteristics of the soil into which it will be installed, i.e., soil density, shear strength, plasticity, moisture content, and grain size.

Each metal foundation can be designed to exceed the load requirements of the structure which will be installed upon it. These loads are in four basic modes including (1) overturning moment capacity, (2) torsional moment capacity, (2) compressive load capacity, and (4) uplift capacity. Deflection limits are also calculated where applicable.

Metal foundations typically include, e.g., by way of illustration, a length of schedule 40, A-53 carbon steel pipe, six inches or larger in diameter. Three or four longitudinal fins, e.g., fabricated from A-36 carbon steel plate of the required thickness, are continuously welded to the pipe. These longitudinal fins are positioned 120 degrees from each other in the case of three fins or 90 degrees in the case of four fins. A carbon steel plate of the required thickness is continuously welded at the top of the pipe column and to the top end of the fins and is drilled and tapped to accept the mounting plate of the structure to be supported by the foundation.

In the case of airport signs and depending on the overall length of the sign, two foundations may be required, and a second "sign plate" may be required also. The length and width of the second steel plate depends upon the length and width of the airport sign as measured at its base. In the case of more than one foundation, the "sign plate" is bolted to the top plate of each foundation. All structural dimensions are calculated on the basis of the loads to be supported by the foundation.

Prior to attaching the airport sign to the foundation, a plastic boot can be bolted onto the sign or utility pole plate. This plastic boot can be approximately six inches larger than the sign base, and it stands one and one half inches above grade. The boot is designed and installed to prevent damage, e.g., damage from mowers, to the sign.

The airport sign plate can be drilled and tapped to accept a PVC conduit adapter which is male threaded on one end where it attaches from the bottom to the sign plate and female, PVC to PVC, at the other end. This enables the attachment of a length of PVC conduit to connect the sign to a junction box. In the case of other structures, an opening is provided at the top of the foundation pipe column for a conduit bringing electrical wiring to penetrate inside the structure for actual wiring or electrical connections. These arrangements allow easy wiring for energizing the structure.

The installation of the metal foundation involves pushing the foundation into the soil. This pushing method typically uses an anchor as a reaction point. An anchor at the end of a rod is dropped to the bottom of a shaft augered into the ground. The anchor is pre-stressed by expanding its four radial plates against the soil while compressing it, all done by hydraulic force. The reaction point so established then is utilized for pushing the foundation into the ground by hydraulic forces.

After pushing the foundation into the soil to the desired elevation, in the case of an airport sign foundation, a PVC connector is threaded into the sign plate which can be factory drilled and tapped for that purpose. The airport sign plate then is bolted to the foundation top plate, and a plastic boot then is bolted to the sign or utility pole plate. The airport sign then can be installed on the foundation and the wire installed. The airport sign is then energized. All work can be performed and completed in one day.

In the case of all other types of structures after pushing the foundation into the soil, a conduit is inserted through a small opening at the top of the pipe column below its top plate. This conduit will be used to pull electrical wires through it so as to bring power to the structure to be mounted upon the foundation.

Representative metal foundations are shown in Sero et al. U.S. Pat. No. 4,974,997 and Collins U.S. Pat. No. 5,234,290. The Sero et al. patent and the Collins patent show hydraulically pushing a prefabricated longitudinally-finned cylindrical metal foundation into a pre-augered hole in the ground. The Sero et al. patent and the Collins patent use a central anchor as a reaction point against which the hydraulic cylinders work. Hydraulic cylinders pushing against an I-beam can be held down by outboard or satellite anchors.

Conventional metal foundation installation methods require a preliminary augering step, a separate crane to move the foundation into position and to move the hydraulic pushing mechanism into position, and a central anchor inside the foundation, which anchor generally is removed after the metal foundation is installed in the ground.

It has been found, in accordance with the present invention, that the current technology of metal foundation installation equipment and methods requires the development of a novel mobile (truck-mounted) metal foundation installation machine for installing prefabricated, longitudinally-finned, cylindrical metal foundations into the ground by pushing the metal foundations through pushing forces provided by such a novel mobile (truck-mounted) metal foundation installation machine.

U.S. Pat. No. 4,626,138 discloses a non-impacting pile driver mounted on a low-boy wheeled trailer having ground engaging means. A mast of a spaced apart pair of upright wide-flange I-beams is adapted to have guide rails for slidably guiding a hydraulic ram carriage. The carriage has a sturdy transverse header for receiving the upward reaction force of the hydraulic ram. A pile engaging element has a configuration depending on the type of pile to be driven. The carriage cooperates with a latch means which allows the ram to push the pile step by step. The latch means locks the carriage to the mast at each of a series of locations that are spaced apart vertically. Plunger-like latch members at each side of the carriage are each movable horizontally toward and from locking engagement with abutments on the mast. A double-acting hydraulic cylinder actuates movement for each latch member into the abutments on the mast which are preferably defined by annular collars having inside diameters to slidably receive the latch members.

U.S. Pat. No. 3,869,003 discloses an auger fitted in the hollow portion of a pile to excavate the ground beneath the pile while simultaneously forcing down the pile by a hydraulic pressure device. A tower or leader mast includes a pair of reaction receiving brackets provided vertically at suitable intervals. A pair of hydraulic cylinders push against a structure to push the pile downward, and stoppers engage the corresponding lower faces of the reaction-receiving brackets.

U.S. Pat. No. 5,145,286 discloses a vehicle mounted anchor installer and swinging truck mounted boom.

U.S. Pat. No. 4,637,758 shows developments in placing an auger inside a hollow pile and rotating the auger to excavate the earth in the leading end of the pile.

U.S. Pat. No. 5,018,905 discloses a mobile vehicle or truck mounted core drilling equipment including controls. The drill bit and pipe string used to drill the bore may be used as a piling.

Japanese 62-304868 discloses what appears to be a hydraulic pile pusher driver combined with earth boring and outboard earth anchoring means. Setting and penetrating the pile and excavation is disclosed as can be performed by the same apparatus, thereby permitting construction to be simplified.

Japanese 63-88557 discloses augering so that a hollow pile can be driven without discharging soil, and outboard anchors 52.

Japanese 53-162604 discloses a general combination with outboard anchoring means.

USSR 774418 discloses outboard anchors 5 on support girder 3.

USSR 767285 discloses piles 8 guided by sleeves 9.

It is an object of the present invention to provide a mobile metal foundation push-it and installation apparatus and method.

It is a further object of the present invention to provide a mobile metal foundation push-it and installation apparatus and method which do not use or require a preliminary and separate augering step.

It is yet another object of the present invention to provide mobile metal foundation push-it and installation apparatus and method which do not use or require a separate crane.

It is yet another object of the present invention to provide mobile metal foundation push-it and installation apparatus and method which do not use or require all the numerous steps of moving the anchor and the foundation into position.

It is another object of the present invention to provide mobile metal foundation push-it and installation apparatus and method which do not use or require all the numerous steps of moving the anchor and the foundation into position or to move the hydraulic pushing mechanism into and out of position.

It is another object of the present invention to provide mobile metal foundation push-it and installation apparatus and method which do not use or require a central anchor inside the foundation.

It is another object of the present invention to provide mobile metal foundation push-it and installation apparatus and method which provide important advantages of efficiency and productivity for installing metal foundations inserted into the ground.

These and other objects of the present invention will be described in the detailed description of the invention which follows. These and other objects of the present invention will become apparent to those skilled in the art from a careful review of the detailed description and from reference to the figures of the drawings.

SUMMARY OF THE INVENTION

The present invention provides mobile metal foundation installation apparatus and method including a mobile platform, a metal foundation holder mounted on the mobile platform, and a push-it carriage movably supported on a tower on the mobile platform through controllable positioning to push the metal foundation holder such that hydraulic cylinders push against a header frame held and secured in adjustable side bar securing positions on the side frame of the tower. As the hydraulic cylinders extend to a maximum extension, the bar can be advanced to a lower position in the side frame of the tower. An auger on the mobile platform and aligned below the push-it carriage drills a hole in the ground in advance of pushing the metal foundation into the ground in one step. Outboard satellite anchors hold down the mobile platform when the foundation is pushed into the ground. A second auger mounted and detachable on a crane on the mobile platform drills holes for the outboard satellite anchors. The second auger can swing laterally to dig a left or right side outboard or satellite anchor hole. An extensible satellite anchor augering guide and anchor structural support extends and retracts on both sides of the mobile platform.

DETAILED DESCRIPTION

The present invention includes a novel mobile, truck-mounted metal foundation push-it and installation machine for installing prefabricated, longitudinally-finned, cylindrical metal foundations into the ground by pushing the metal foundations through pushing forces provided by hydraulic cylinders mounted on the mobile, truck-mounted metal foundation push-t and installation machine.

The present invention includes apparatus and method for providing a novel metal foundation push-it and installation machine which includes a truck-mounted crane and a tower for holding a push-it carriage including metal foundation holder and auger. The novel machine and method of the present invention augers a hole and installs the metal foundation in one step as the push-it carriage is pushed toward the ground.

Hydraulic pushing cylinders push against a header frame held in adjustable side bar securing positions on the tower, i.e., the hydraulic cylinders push against a bar secured to each side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes a truck-mounted second auger used to drill holes for outboard or satellite anchors to hold down the truck when the foundation is pushed into the ground. The second auger can swing laterally to dig a left or right side outboard or satellite anchor hole. A truck-mounted extensible satellite anchor augering guide and anchor structural support extends and retracts on both sides of the truck.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

The present invention in one aspect provides an apparatus and method for pushing into the ground a pipe-column-type foundation with or without longitudinal fins alongside the pipe column.

Figure 1:
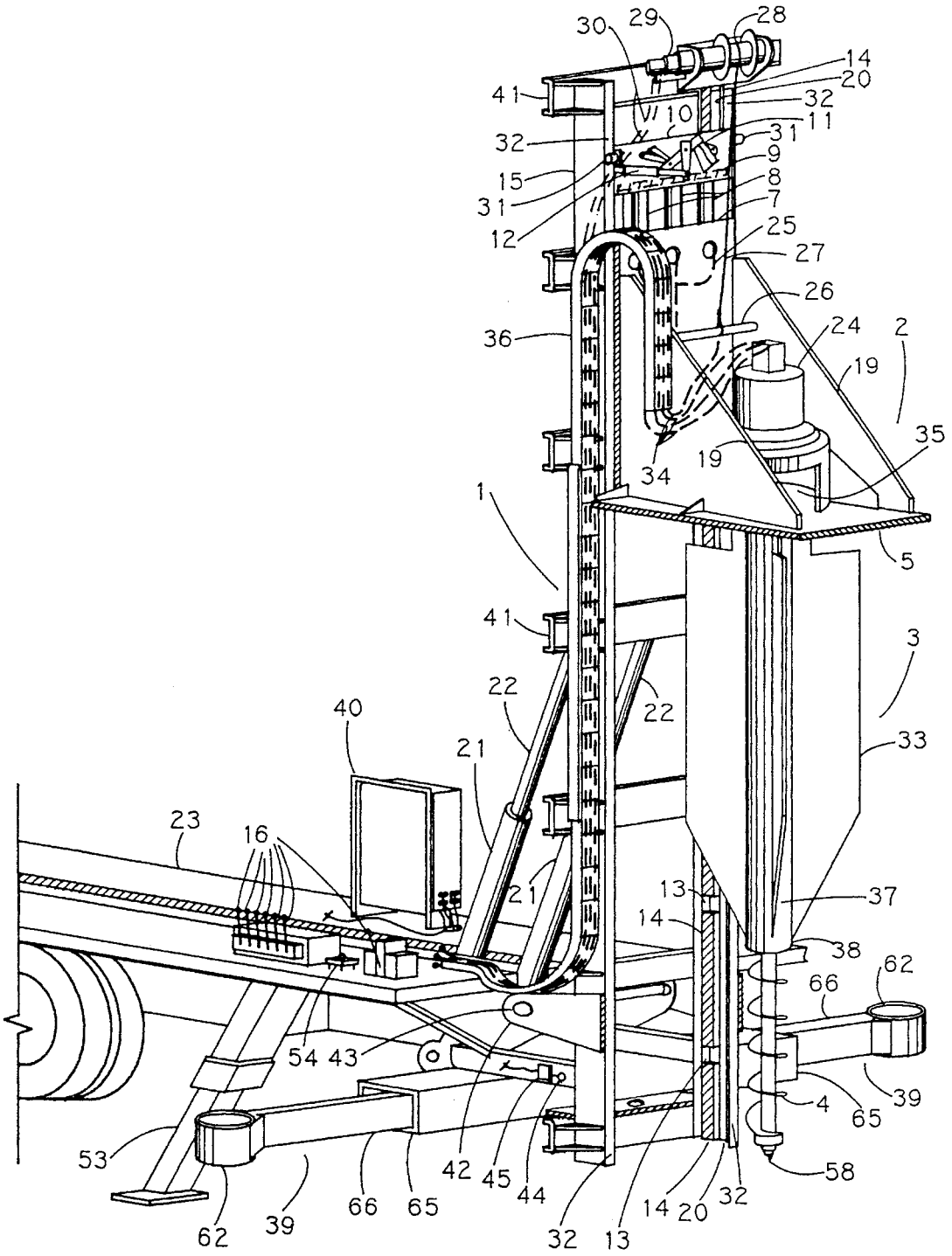
FIG. 1 is a partial perspective view of an apparatus for installing a pipe foundation in the ground in accordance with the present invention.

FIG. 1 shows the apparatus of the present invention, also called metal foundation push-it and installation machine, in a partial perspective view mounted on a truck. FIG. 1 shows a pivoting structural support tower in its operating position, its pivoting plate assembly, pivoting pin, and the tower's pair of hydraulic cylinders with their respective piston rods extended, in the tower raising mode. FIG. 1 shows a pushing/augering carriage with its reinforcement plates, its lower pushing plate, its sliding back-plate, its lifting bar, and a hydraulic motor for augering and the motor augering spoils outlet. Also shown, behind the sliding back-plate of the pushing/augering carriage, is a portion of three partially extended piston rods from three respective hydraulic cylinders (not shown). FIG. 1 shows a locking dogs mechanism mounted on a plate frame with wheels on its front plate. FIG. 1 shows, in dotted lines, an upper pushing plate behind a front plate. FIG. 1 shows vertical, thrust resistance bars on the tower's inside and cavities created by the vertical bars such that a pair of locking dogs (bars) (not shown) can lock into the vertical bars. Also shown are a winch with its cable and its hydraulic motor, for operating the winch. FIG. 1 shows a finned pipe foundation with an auger inserted into its pipe column, both mounted on the carriage and a flexible power track containing several hydraulic fluid carrying hoses. Also shown are several operating control levers, two adjustably extendable truck uplift resistance assemblies and augering guides, one of four truck outriggers, a level on the truck bed, the container for transporting a remote operating control box, and several hydraulic fluid carrying hoses and connections.

Referring now to FIG. 1, metal foundation push-it and installation machine 1 is provided with pushing/augering carriage 2, which is utilized for pushing a pipe-column-type foundation 3 into the ground while concomitantly augering an earthen hole ahead of foundation bottom end 38 by means of auger 4. Foundation 3 can incorporate fins 33 along side pipe column 37. Foundation 3 also may be installed without fins 33. Auger 4 extends, e.g., by way of illustration, approximately two feet beyond bottom end 38. Carriage 2 having lower pushing-plate 5 pushes on Foundation 3. Lower pushing-plate 5 receives its pushing force from a group of hydraulic cylinders 6, preferably three in number, shown through a cut-away view on FIG. 2 with their respective piston rods 8 extended, i.e., in the pushing mode. Hydraulic cylinders 6 are mounted on lower pushing plate 5 behind sliding back-plate 7. Sliding back-plate 7 is attached to lower pushing-plate 5 and is provided with wheels (not shown) which roll inside channel 20 of tower 15 on both sides to allow for a smooth up/down movement of carriage 2.

Continuing to refer to FIG. 1, piston rods 8 push upwardly against upper plate 9. Piston rods 8 are attached to upper plate which is part of frame 10. Frame 10 is a rigid, box-like frame made of thick steel plates. Frame 10 houses a set of two locking dogs, i.e., locking steel bars (not shown). Locking dogs operating mechanism 11 operates the locking dogs (not shown) by means of hydraulic cylinder 12. Locking dogs mechanism 11 moves the locking dogs sideways into cavities 13 created by thrust resisting bars 14 which are vertically mounted on tower 15, i.e., structural frame 15. Cavities 13 are spaced at equal intervals of approximately three feet on each side from the top of structural frame 15 down to its bottom. Cavities 13 are the spaces created between each of two vertically adjacent thrust resisting bars 14. The locking dogs mechanism 11 is mounted on frame 10. An operator, by means of one of several control levers 16 or from a remote control box (not shown), actuates hydraulic cylinder 12 which operates the locking dogs mechanism 11.

Structural support tower 15, shown in the working mode, i.e., vertically, is provided with a pair of hydraulic cylinders 21 with its piston rods 22 for collapsing tower 15 back onto truck bed 23 for transportation purposes. Raising or lowering tower 15 is performed by an operator using levers 16 or from a remote control box.

Operating the locking dogs mechanism by the operator refers to making hydraulic cylinder 12 force the locking dogs (locking bars) into cavities 13 on both sides of tower 15 so that piston rods 8 can push against upper plate 9. Piston rods 8 push against upper plate 9, which is part of frame 10, which in turn houses the locking bars (not shown). The upward thrust of hydraulic cylinders 6 (FIG. 2) is effectively transferred by means of their piston rods 8 onto structural tower 15 by means of the tower's thrust resisting bars 14. These bars are approximately three feet in length and are installed vertically on both sides of the tower 15 at equal intervals from top to bottom, thereby leaving a space between each two cavities 13, i.e., vertically, at equal intervals on both sides of tower 15 from top to bottom. Thrust resistance bars 14 are firmly attached to tower 15, preferably by weldments.

By transferring the powerful, upwardly pushing force of hydraulic cylinders 6 (FIG. 2) by means of their piston rods 8 onto tower 15 (which cannot move up or down), pushing/augering carriage 2 can slide downwardly on tower 15. Pushing/augering carriage 2 will actually receive the resulting pushing force of hydraulic cylinders 6 because bottoms 17 (FIG. 2) of hydraulic cylinders 6 rest upon and are firmly attached to the back end 18 (FIG. 2) of lower pushing plate 5. Hydraulic cylinders 6 are positioned behind sliding back-plate 7, which together with reinforcement plates 19 and lower pushing plate 5 form the pushing/augering carriage 2.

The pushing force provided by hydraulic cylinders 6 (FIG. 2) by means of their piston rods 8 and exerted on pushing/augering carriage 2 pushes foundation 3 into the ground. Hydraulic fluid carrying hoses 25 connect hydraulic cylinders 6 (FIG. 2) to the system's hydraulic pumps 85 (FIG. 7) mounted on the front end of truck bed 23.

Pushing/augering carriage has hydraulic motor 24 mounted on the top surface of its lower pushing plate 5. Hydraulic motor 24 provides the power for augering an earthen hole by means of auger 4, ahead of the advance of bottom 38 of foundation 3, into the soil as foundation 3 is pushed downward into the ground by pushing/augering carriage 2.

Hydraulic fluid carrying hoses 34 connect hydraulic motor 24 to the push-it machine's hydraulic pumps 85 (FIG. 7) mounted on the front end of truck bed 23. Hydraulic hoses 34 are mounted on flexible power track 36, which flexes as carriage 2 moves up or down.

Hydraulic motor 24 is provided with augering spoils outlet 35 for the purpose of expelling soils removed during augering which takes place during the process of pushing foundation 3 into the ground. Pushing/augering carriage 2 is also provided with lifting means for lifting pushing/augering carriage 2 back after foundation 3 has been pushed into the ground and for holding pushing/augering carriage 2 in place when required. Lifting bar 26 is attached to winch cable 27, and cable 27 is attached to winch 28 which is installed at the top end of structural support tower 15. Hydraulic motor 29 utilized for powering winch 28, and it is operated by one of control levers 16 or from a remote control box (not shown). Hydraulic fluid carrying hoses 30 connect hydraulic motor 29 to the system's hydraulic pumps 85 (FIG. 7) mounted on the front end of truck bed 23.

Frame 10 containing locking dogs mechanism 11 is provided with four wheels 31. Two of these wheels 31 roll on outside face 32 on both sides of structural support tower 15. The other two wheels 31 (not shown) roll inside channel 20, also on both sides of tower 15.

During test runs of push-it machine 1, it was found that push-it machine 1 could push into the ground small size foundations. Nevertheless, for largesse size foundations, the weight of the apparatus including the thick was a factor in respect to holding down push-it machine 1. Therefore, the present invention also provides novel extendably adjustable truck uplift resistance assembly 39.

Extendably adjustable uplift resistance assembly 39 is utilized for attaching metal foundation push-it and installation machine 1 by bolting down to conventional outboard earthen anchors 57, e.g. , such as described in U.S. Pat. No. 4,843,785 and for guiding an auger for augering an earthen hole for setting earthen anchors 57 therein. Pushing/augering carriage 2 with its hydraulic motor 24, frame 10, including the locking dogs mechanism 11 with its hydraulic cylinder 12 and locking dogs (bars) (not shown), hydraulic cylinders 6 (FIG. 2), winch 28 with its hydraulic motor 29, and power track 36 are all installed on the structural support pivoting tower 15 which itself is structurally reinforced by bracings 41. Tower 15 is a pivoting tower, i.e., it can be swung back onto truck bed 23 for transportation purposes and can be raised again by means of hydraulic cylinders 21, pivoting plate assembly 42, and pivoting pin 43. The operator raises and lowers tower 15 by means of levers 16 or by means of a remote control box (not shown).

A hydraulic boom lift 48 (FIG. 4), e.g., such as in one embodiment a crane lifting arm, is installed on the truck bed 23 for the purpose of lifting into position foundation 3, auger 4, and any other equipment as needed.

To provide personnel safety as well as machine safety, the present invention provides safety pins 44 and safety switch 45. When tower 15 is raised to its working position, i.e., vertically, the operator inserts switch 44 into its safety position, which activates safety switch 45, which in turn deactivates the raise/lower function that operates the hydraulic cylinders 21. This operates to prevent the operator from accidentally pushing a control command that could make hydraulic cylinders 21 lower tower 15 while a foundation 3 is being pushed into the ground.

Steel container 40 is provided for transporting the remote control box and for storage not being used.

Figure 2:
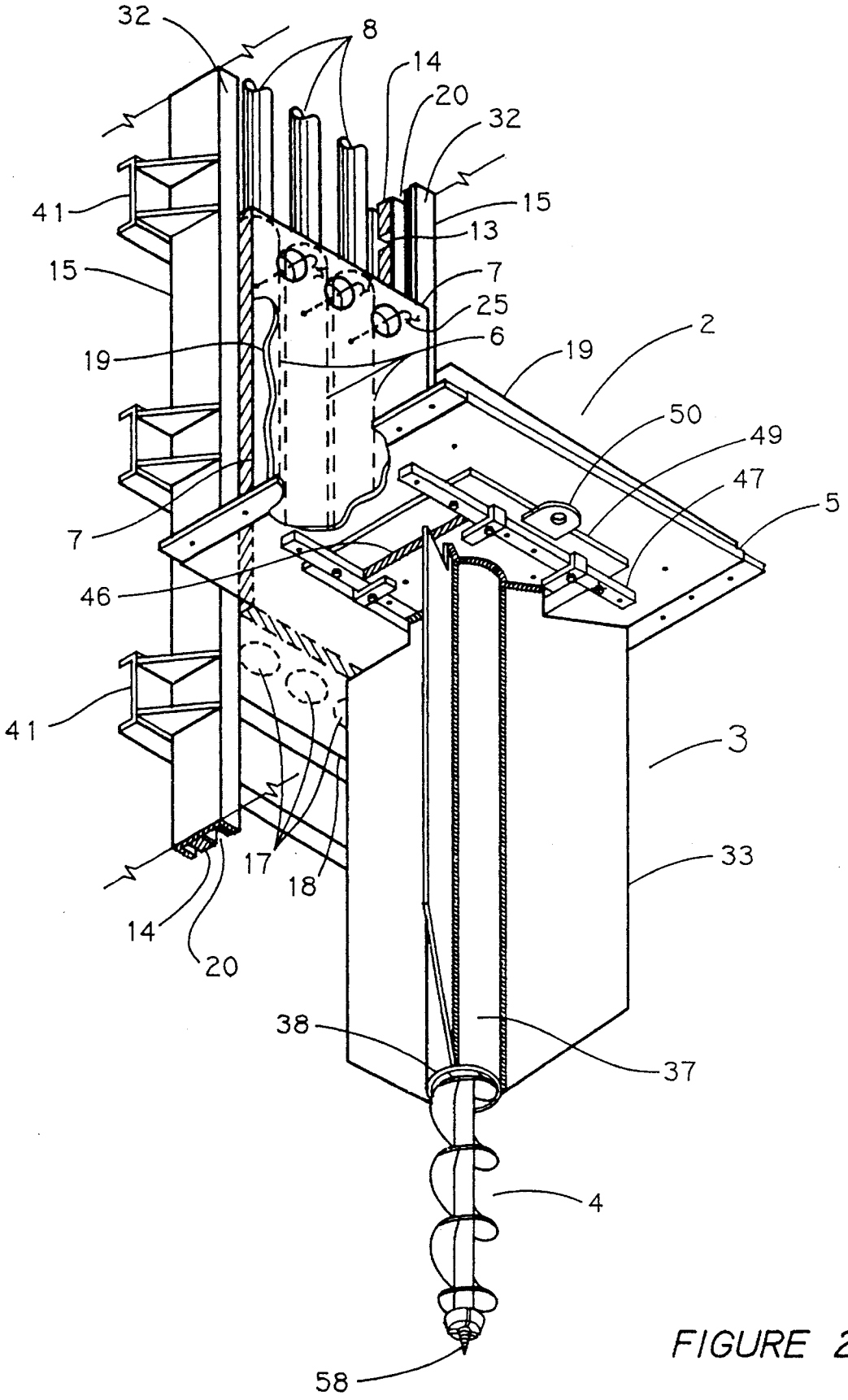
FIG. 2 is a perspective view partially showing the apparatus for installing a pipe foundation and also showing a pushing augering carriage with a pipe foundation and an auger attached thereto.

FIG. 2 is a perspective view of the augering and pushing carriage assembled on a support tower. FIG. 2 shows a lower pushing plate with a foundation attachment device on its underside, a finned-pipe foundation attached thereto, and an auger installed inside the pipe column and attached to a hydraulic motor (not shown). Also shown on FIG. 2 through a cut-away perspective view are three hydraulic cylinders behind the carriage-sliding back-plate The bottoms of the hydraulic cylinders are attached to the lower pushing plate, and their piston arms, e.g., piston rods, are extended upwardly in the operational mode, i.e., the upwardly pushing mode, FIG. 2 shows hydraulic fluid carrying hoses connected to hydraulic cylinders. In addition, FIG. 2 shows thrust resistance bars vertically installed on the tower and cavities created by the spaces between each two vertical thrust resistance bars.

Referring now to FIG. 2, top-plate 46 of foundation 3 attaches to the underside of lower pushing plate 5 of pushing/augering carriage 2 by means of foundation attachment device 47, while auger 4 attaches by means of a hexagonal socket (not shown) to a hexagonal power shaft (not shown) from hydraulic motor 24 (FIG. 1) which protrudes through the underside of lower pushing plate 5.

Foundation attachment device 47 is provided with adapter plate 49, which is utilized when smaller size foundation 3 (with or without fins 33) are to be installed by metal foundation push-it and installation machine 1. Adapter plate 49 is easily removed by unbolting it and then lifting it by means of onboard, hydraulic boom lift 48 (FIG. 4) and lifting eye 50.

Figure 4:
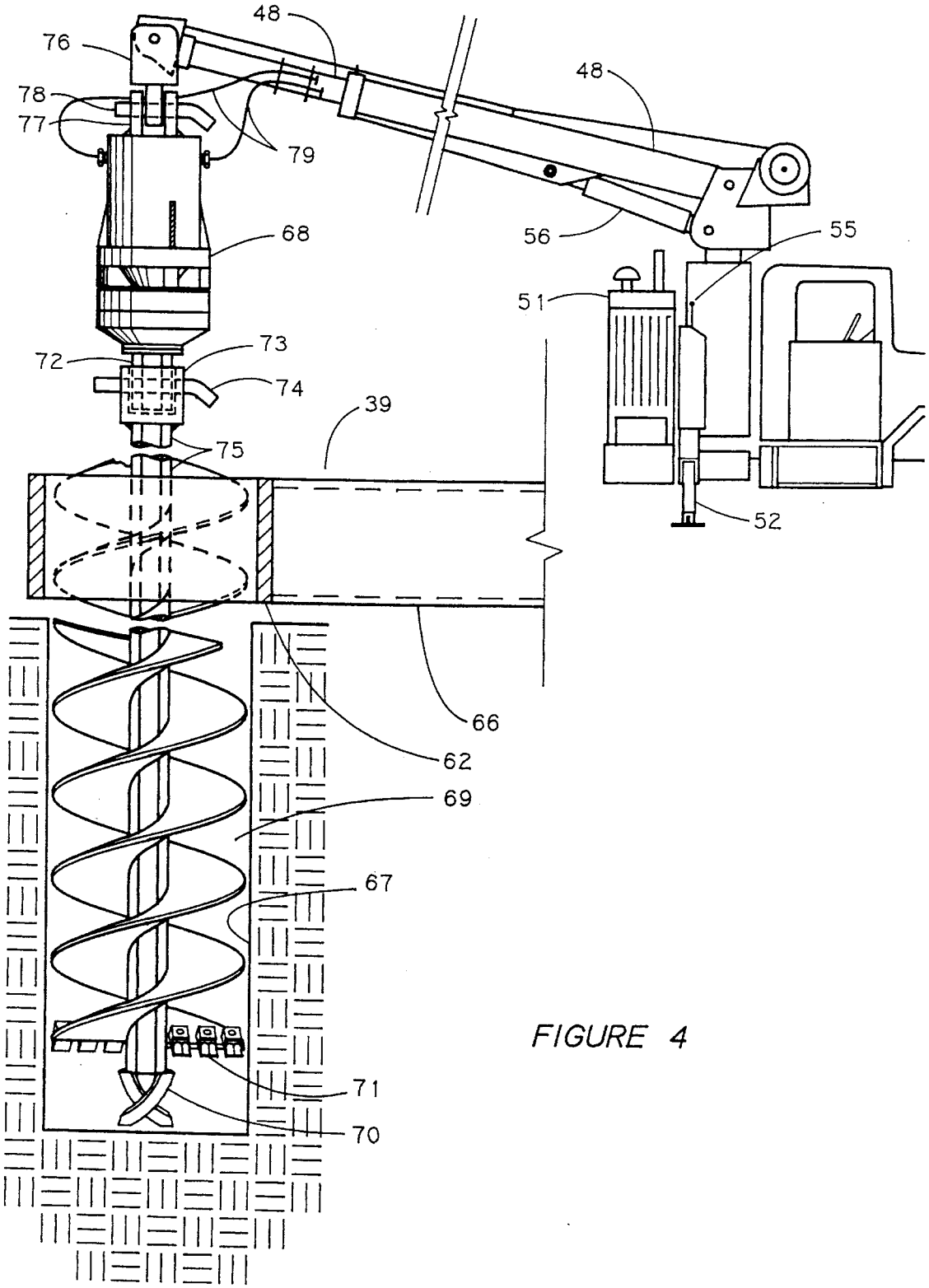
FIG. 4 is an elevation view, partially in section, showing an earthen hole augered for the purpose of installing satellite anchors in accordance with the present invention and also for installing augers in the anchor mode without an earthen hole, also in accordance with the present invention.

The process of mounting foundation 3 on the underside of carriage 2 by means of attachment device 47 is simplified by utilizing boom lift 48 (FIG. 4). Firstly, auger 4 is attached to the hexagonal power-shaft (not shown) of hydraulic motor 24, also by lifting it and holding it in place until it is attached by means of hydraulic boom lift 48 (FIG. 4). Secondly, foundation 3 is lifted also by boom lift 48 and placed over auger 4, whereby auger 4 passes through the inside of foundation 3 pipe column 37. Then, while holding foundation 3 in the required position until it is attached, top plate 46 is firmly attached by means of foundation attachment device 47 either to adapter plate 49 and lower pushing plate 5, if it is a smaller foundation, or directly to lower pushing plate 5, if it is a larger foundation, also by means of attachment device 47. In both cases, the attachment is done by bolting. The attaching of foundation 3 onto pushing/augering carriage 2 by means of attachment device 47 preferably is done with tower 15 in the horizontal position, e.g., such as by laying down on the truck bed.

Pushing/augering carriage 2 comprises lower pushing plate 5, two side reinforcing plates 19, and sliding back-plate 7 which rests on and is attached to the back end 18 of lower pushing plate 5 and which has wheels on its back side (not shown) that roll inside channel 20 provided on both sides of tower 15 to allow the entire carriage to move smoothly up and down. In addition, the pushing/augering carriage 2 is provided with a foundation attachment device 47 and a powerful hydraulic motor 24 (FIG. 1) for rotatably powering auger 4.

The bottoms 17 of hydraulic cylinders 6 are attached to lower pushing plate 5 onto its back end 18 to transfer downwardly onto carriage 2 the pushing force exerted by their piston arms 8 against thrust resisting bars 14. Thrust resisting bars 14 are vertical bars on both sides of tower 15 which resist the upward push of piston rods 8 as they are extended upwardly, out of hydraulic cylinders 6, by hydraulic fluid pumped into the hydraulic cylinders at an operator's commands.

Figure 7:
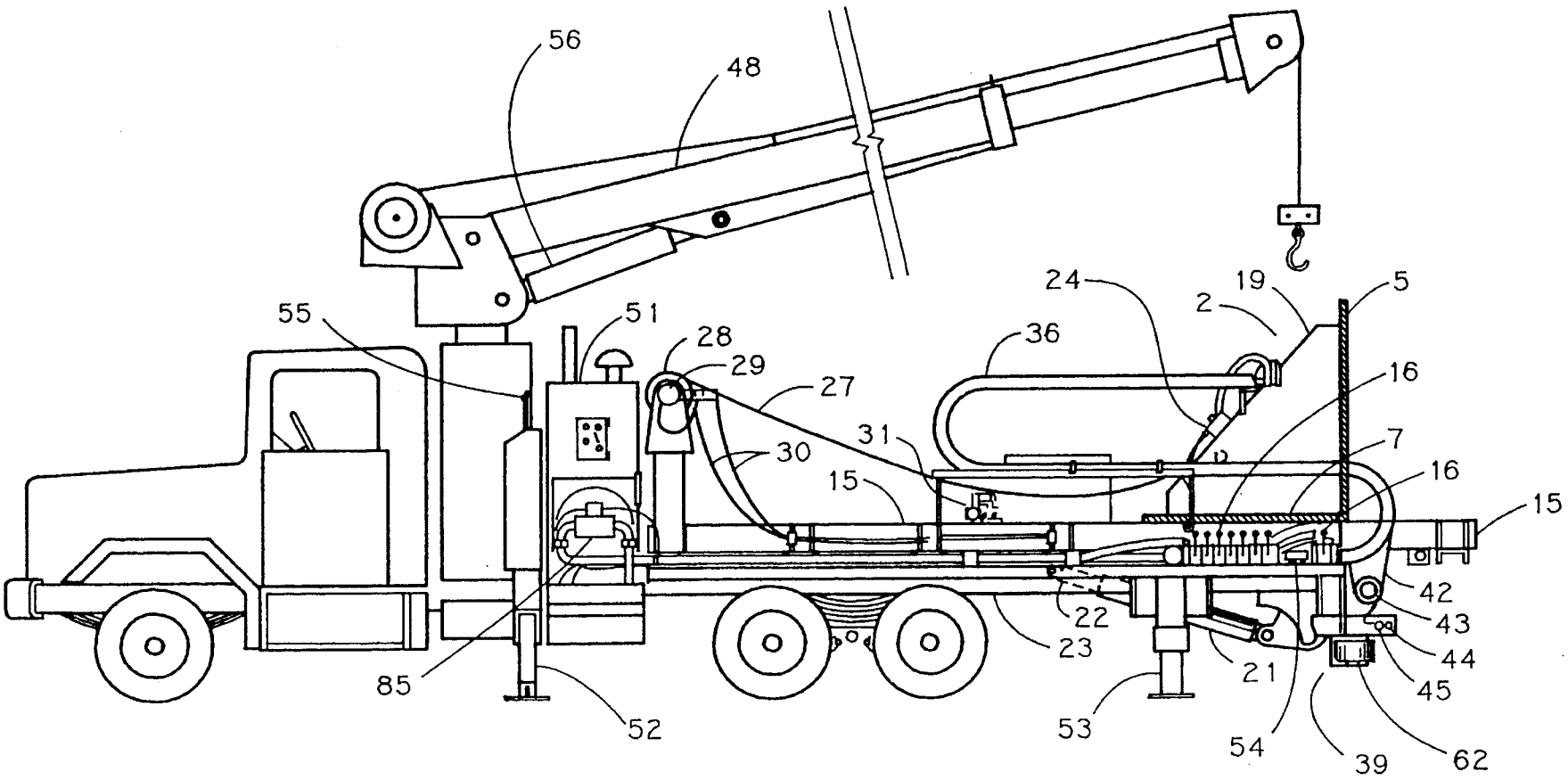
FIG. 7 is an elevation view, partially in section, of the apparatus of the present invention mounted on a truck.

Hydraulic cylinders 6 are operated by the operator by means of control levers 16 or by a remote control box (not shown). All hydraulic and electrical operating functions of the apparatus of the present invention, including the hydraulic boom lift 48 (FIG. 4), are controlled by the operator by means of control levers 16 or by means of the remote control box. Boom lift 48 is also operated from control levers 55 (FIGS. 4 and 7).

Figure 3:
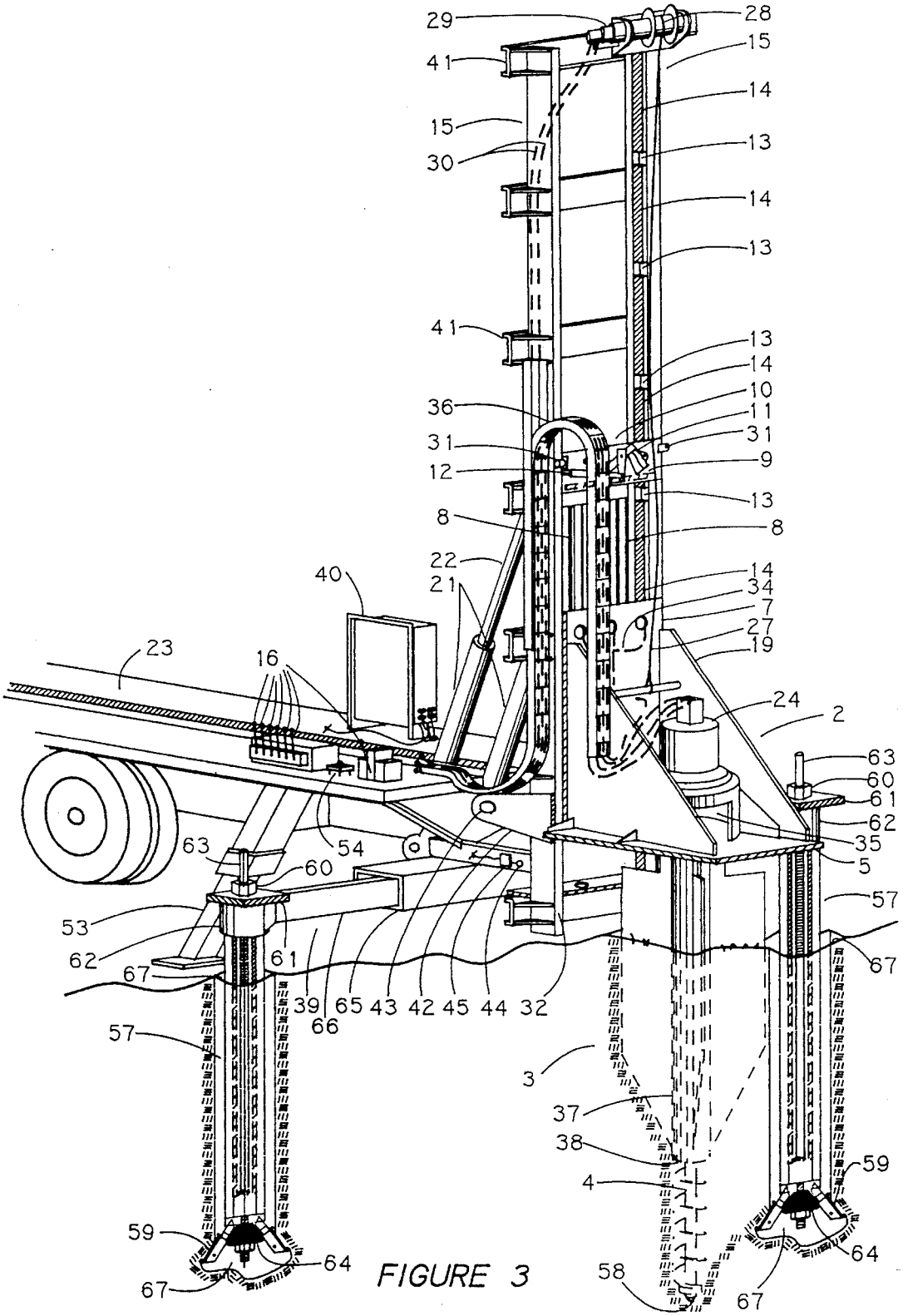
FIG. 3 is a perspective view of the apparatus of the present invention in the process of installing a pipe foundation and showing a cut-away view of two satellite anchors.

FIG. 3 is a perspective view of the apparatus of the present invention mounted on a truck in the process of installing a conventional metal foundation into the soil. FIG. 3 shows two conventional satellite outboard earthen anchors as described in U.S. Pat. No. 4,843,785. FIG. 3 shows the conventional metal anchors set into the soil and pre-stressed, i.e., with their outwardly swingable compaction and consolidation plates already swung outwardly into the soil. It shows the conventional earthen anchors attached to respective extendably adjustable uplift resistance assemblies/augering guides by means of respective uplift resistance plates and nuts. FIG. 3 shows a pivoting structural support tower in its working position, its pivoting plate assembly, pivoting pin, and the tower's pair of hydraulic cylinders with their respective piston rods extended in the tower raising mode. FIG. 3 shows a pushing/augering carriage with its reinforcement plates, its lower pushing-plate, its sliding back-plate, and its lifting bar. FIG. 3 shows a hydraulic motor for augering and its augering spoils outlet. Also shown, behind the sliding back-plate of the pushing/augering carriage, is a portion of three partially extended piston rods from three respective hydraulic cylinders (not shown). FIG. 3 shows a locking dogs mechanism mounted on a plate frame with wheels on its front plate and rolling against the face of the structural support tower. Also shown in dotted lines behind the front plate is an upper pushing plate. FIG. 3 shows vertical thrust resistance bars on the tower's insides and cavities created by the vertical bars for a pair of locking dogs (bars) (not shown) to penetrate and lock into. It shows a winch with its cable and its hydraulic motor for operating the winch. In addition, it shows a finned pipe foundation with an auger inserted into its pipe column, both mounted on the pushing/augering carriage. FIG. 3 shows a flexible power track for holding several hydraulic fluid-carrying hoses. It shows several operating control levers, two extendably adjustable, uplift resistance assemblies with augering guides, one of four truck outriggers, a level on the truck bed, a container for transporting a remote-operating control box (remote control box not shown) and several hydraulic fluid carrying hoses and connections.

Referring now to FIG. 3, a conventional finned pipe foundation 3 is shown in the process of being installed in the ground by metal foundation push-it and installation machine 1 of the present invention. Foundation 3 is shown already partially pushed into the soil. Foundation 3 can have a plurality of fins, or can be without fins, i.e., a pipe column with a suitable top plate 49 (FIG. 2) attached to it, generally by weldments. When the foundation installation process begins, tower 15 is preferably lying horizontally on the truck bed 23 (FIG. 7). The operator by means of an on board, hydraulically operated boom lift 48 (FIG. 4) picks up auger 4 and attaches it to hydraulic motor 24 from the underside of lower pushing plate 5. Hydraulic boom lift 48 (FIG. 4) has its own hydraulic cylinder 56. Auger 4 is provided with a conventional kelly bar, hexagonal adapter and pin (both not shown) to couple auger 4 to the hydraulic motor's hexagonal, power shaft (both not shown).

The hydraulic boom lift 48 (FIG. 4) is mounted on truck bed 23 at the opposite end to tower 15 pivoting point 43.

After auger 4 is attached and secured to hydraulic motor 24 located on the pushing/augering carriage 2, the operator proceeds to pick up foundation 3 by means of the hydraulic boom lift and attaches foundation 3 to the underside of lower pushing-plate 5 of carriage 2 by means of foundation attachment device 47 (FIG. 2). Larger size foundations do not require adapter plate 49. When the foundation 3 and auger 4 through its pipe column 37 are firmly attached to the underside of pushing augering carriage 2. Next, the operator raises tower 15 from its horizontal position on truck bed 23 to its working position, i.e., vertically, by means of control levers 16 or the remote control box. The hydraulic pumps 85 (FIG. 7) are powered by diesel engine 51, and they are provided for powering all the hydraulic cylinders on metal foundation push-it and installation machine 1. Hydraulic pumps 85 (FIG. 7) are mounted on the same area of the truck bed 23 as diesel engine 51.

The hydraulic operating functions are operated from control levers 16 or from a remote control box (not shown) connected to control levers 16 via an umbilical cord (not shown). The hydraulic operating functions of boom lift 48 (FIG. 4) and front end outriggers 52 can also be operated from control levers 55.

The operator then must determine whether or not to install satellite earthen anchors 57 to prevent metal foundation push-it and installation machine 1 from being lifted off the ground when operating to push foundation 3 into the soil. The operator will make that decision based on the size of the foundation and further based on the physical characteristics of the soil from soil tests results available to the operator.

Foundations are designed specifically for supporting loads. The loads to be supported by any foundation and the physical characteristics of the soil where the foundation will be installed determine the size of the foundation and the depth at which it will be pushed into the soil.

Conventional industry practice makes it standard procedure for a foundation contractor to know the physical characteristics of the soil before a foundation is installed.

For harder soils or longer foundations, greater is the force required to push the foundation into the soil. In the process of pushing the foundation downwardly, piston arms 8 of hydraulic cylinders 6 (FIG. 2) push upward against frame 10 which tends to lift metal foundation push-it and installation machine 1 off the ground because frame 10 is locked onto tower 15 by means of its locking dog bars. The present invention provides methods and means to prevent the uplifting of the metal foundation push-it and installation machine 1 when required. For smaller foundations in soils which are not too hard (accordingly to well known, standard soil classifications), metal foundation push-it and installation machine 1 will push foundation 3 into the soil without requiring installing conventional satellite earthen anchors 57.

Continuing to refer to FIG. 3, the operator drives the truck so as to locate auger 4 and foundation 3 over the correct location where foundation 3 will be installed by the apparatus of the present invention. The operator then proceeds to lift the truck off its tires and to set metal foundation push-it and installation machine 1 to a leveled position by extending truck front outriggers 52 and truck rear outriggers 53 by means of control levers 16 or the remote control box. The operator watches level 54 to bring the apparatus of the present invention to a leveled position.

This is the method the operator applies for pushing a foundation down into the soil. The operator lowers pushing/ augering carriage 2 to a point where the tip 58 of auger 4 is very close to the soil. The operator by means of the remote control box or via control levers 16 operates hydraulic cylinder 12 by extending its piston rod to make the locking dogs mechanism 11 pull the locking dogs (bars) (not shown) out of cavities 13 on both sides of tower 15. By unlocking the bars out of cavities 13, frame 10 is free to move on wheels 31 which roll on the face 32 of tower 15 and on wheels (not shown) which roll inside channel 20.

When the locking bars from locking dogs mechanism 11 unlock out of cavities 13, pushing/augering carriage 2 carrying hydraulic cylinders 6 on the back end 18 (FIG. 2) of its lower pushing plate 5 and frame 10 attached to piston rods 8 is free to move on its wheels (not shown) which roll inside channel 20 (FIG. 2). Nevertheless, pushing/augering carriage 2 cannot move down because it is firmly held in place by cable 27 of winch 28. If it was not held in place, it would rapidly fall. Now the operator from the remote control box or via control levers 16 operates cylinders 6 (FIG. 2) and makes the respective piston rods 8 retract into the respective cylinders 6, thereby pulling down to a lower position frame 10 which contains the locking dogs mechanism 11 and the locking dog bars (not shown).

Then the operator from the remote control box or from levers 16 reverses the flow of hydraulic fluid in cylinder 12 making its piston rod retract which, in turn, by means of locking dog mechanism 11 forces the locking dogs bars into a new set of cavities 13 at the lower position frame 10 was pulled down to by piston rods 8 when they were made to retract into their respective cylinders 6 (FIG. 2) by the operator.

One end of the locking bars (not shown) then has penetrated into respective cavities 13, one at each side of tower 15. The other end (not shown) is firmly attached to the locking dogs mechanism 11 and therefore to frame 10. Cavities 13 are made of each set of two thrust resisting, vertically attached bars 14. Therefore, by moving the locking bars into this new set of cavities 13, frame 10 cannot move up or down. Frame 10 is immobilized in that position.

Now the operator can make cylinders 6 (FIG. 2) via their respective piston rods 8 push against this fixed, immobilized frame 10. But first, the operator releases winch 28 via the remote control box or via control levers 16 to allow pushing/augering carriage 2 to move because of the push exerted by piston rods 8 against upper pushing plate 9. Carriage 2 cannot free-fall because the dogging bars are now locked in a new set of cavities 13, thereby to prevent free-falling.

The operator now lowers pushing/augering carriage 2 by means of the remote control box or levers 16. The operator activates hydraulic cylinders 6 (FIG. 2), i.e., to make hydraulic fluid flow into the cylinders in the direction that pushes their respective pistons rods 8 out of their respective cylinders. Because piston rods 8 are firmly attached to upper pushing plate 9 of frame 10 and because frame 10 is locked in place by its locking dog (bars) preventing frame 10 from moving, the pushing force of hydraulic cylinders 6 (FIG. 2) is exerted on the pushing/augering carriage 2, effectively pushing it downwardly.

If the pushing/augering carriage 2 with foundation 3 and auger 4 attached to it are farther up on tower 15, more than one lowering cycle may be required because on each lowering cycle, pushing/augering carriage 2 can only be lowered for a distance equal to the distance between cavities 13, e.g., such as, approximately three feet. This distance bears a relationship to the maximum stroke provided by hydraulic cylinders 6 (FIG. 2), i.e., the maximum length piston rods 8 can extend out of their respective cylinders 6.

Now, therefore, the augering/pushing carriage 2 with auger 4 and foundation 3 attached to the carriage have been lowered to a point where the tip 58 of auger 4 is very close to the soil. By repeating these pushing cycles, the foundation is pushed into the soil if it was a smaller foundation or softer soils not requiring uplift resistance means.

Next the operator proceeds to set in the soil two conventional outboard satellite earthen anchors 57 all in accordance with the apparatus and methods described in U.S. Pat. No. 4,843,785. These earthen anchors 57 are to be attached to the novel extendably adjustable uplift resistance assembly 39 provided by the present invention.

When two satellite anchors 57 are set in the soil and their outwardly swingable compaction and consolidation plates 59 have been outwardly swung, i.e., stressed against the soil in earthen hole 67 and prior to removing their installation apparatus (not shown), uplift resistance nut 60 is tightened against uplift resistance plate 61 set upon guide 62. Uplift resistance nut 60 threads on threaded rod 63 of conventional earthen anchor 57 which, in turn, holds spreader cone 64 in place which, in turn, keeps outwardly swingable compaction and consolidation plates 59 stressed against the soil, i.e., exerting great force against the soil. Each earthen anchor 57 has four such plates 59 at approximately ninety degrees from each other (four of such plates are not shown).

Extendably adjustable uplift resistance assembly 39 is comprised of structural arm guide 65, adjustable sliding arm 66, augering guide 62, and a pair of hydraulic cylinders (not shown) inside structural arm guide 65. Such hydraulic cylinders are utilized by the operator to extend the adjustable sliding arms 66 to the desired position where earthen anchors 57 are to be placed. Such hydraulic cylinders are operated from the remote control box of from control levers 16.

When two satellite anchors 57 are stressed against the soil and firmly attached to uplift resistance assembly 39 by means of uplift resistance nut 60 and uplift resistance plate 61, metal foundation push-it and installation machine 1 is ready for pushing foundation 3 into the soil by means of pushing/augering carriage 2.

As pushing/augering carriage 2 pushes downwardly foundation 3, auger 4 augers an earthen hole ahead of the advance of bottom end 38 of foundation 3 into the soil. Auger 4 extends approximately two feet beyond bottom end 38 of foundation 3.

The force exerted by piston arms 8 of hydraulic cylinders 6 (FIG. 2) on top plate 46 of foundation 3 is resisted by the soil the foundation is being pushed in. The resistance is transmitted to tower 15 via the locking dog bars contained in frame 10, pushing against thrust resistance bars 14. This soil resistance is greater than the downward force provided by the weight of push-it machine 1, and therefore, the force provided by hydraulic cylinders 6 would uplift the push-it machine 1 for larger foundations or for hard soils.

Nevertheless, this uplift is resisted by the novel, extendably adjustable uplift resistance assembly 39 which is anchored to the soil via two satellite earthen anchors 57. The uplift resistance capacity of the uplift resistance assembly 39, when attached to earthen anchors 57 and the pushing force provided by hydraulic cylinders 6 (FIG. 2), are individually greater than the resistance the soil can exert against the push of foundation 3 into it, and therefore, foundation 3 is effectively pushed into the soil by piston rods 8 of hydraulic cylinders 6 (FIG. 2).

Foundation 3 is pushed at intervals of approximately three feet at a time because of the maximum stroke length provided by hydraulic cylinders 6.

After each pushing interval, the dogging bars have to be disengaged by means of hydraulic cylinder 12 and mechanisms 11 from cavities 13. Frame 10 which contains the dogging bars must be lowered by retracting piston arms 8 back into their respective hydraulic cylinders 6. Piston arms 8 are firmly attached by weldments or by other means to frame 10. For that reason, piston arms 8 pull down frame 10 when they retract into their respective cylinders 6. Frame 10 is pulled down to the top end of sliding plate 7, and at that level, the operator re-engages the dogging bars into a new set of cavities 13 and releases winch 28. Now a new downwardly pushing cycle can commence. All operations are commanded by the operator either from control levers 16 or from a remote control box connected to metal foundation push-it and installation machine 1 by a conventional umbilical cord (not shown).

After the foundation has been pushed into the soil, earthen anchors 57 are removed by the operator with the help of the onboard boom lift.

FIG. 4 is an elevation view, partially in section, showing an auger in the process of augering, i.e., boring, an earthen hole, a portion of an extendably adjustable sliding arm, an augering guide, and a hexagonal coupling attached to the auger's kelly bar and connected to a hydraulic motor and a safety pin. Also shown is a pivoting plate assembly attached to a hydraulic boom lift. The boom lift mounted on a flatbed truck, control levers to operate the boom lift and a front outrigger, are also shown. FIG. 4 shows the augers cutting head and augering teeth and hydraulic fluid carrying hoses.

Referring now to FIG. 4, the present invention provides the method and on board means for boring earthen holes 67 required for installing earthen anchors 57. The present invention provides hydraulic motor 68 for powering conventional auger 69 which is utilized for augering earthen hole 67. Auger 69 is provided with cutting head 70 and augering teeth 71. Auger 69 is attached to hexagonal power shaft 72 of hydraulic motor 68 by means of hexagonal coupling 73 and pin 74. Coupling 73 is attached by weldments to auger 69 kelly bar 75.

Hydraulic motor 68 is provided with attachment plates 77 which attach to boom lift 48 by means of attachment plate assembly 76 and pin 78. Hydraulic fluid is pumped to and from hydraulic motor 68 through hydraulic hoses 79. The operation of hydraulic motor 68 is controlled by the operator from control levers 16 (FIG. 1 and 3) or from the remote control box.

The operator picks up auger 69 by means of boom lift 48 and places it through augering guide 62 of the extendably adjustable uplift resistance assembly 39. Adjustable sliding arm 66 has been extended first to the required position by the operator. Next, the operator lowers boom lift 48 by means of control levers 16 or 55 to a point where the operator keeps the hydraulic motor 68 on truck bed 23 and manually attaches hydraulic motor 68 to the attachment plate assembly 76 of boom lift 48 by means of pin 75.

The operator now moves boom lift 48 carrying hydraulic motor 68 in such a manner to insert the motor's hexagonal power shaft 72 into coupling 73. Generally, an operator and a helper are utilized for all the operations of metal foundation push-it and installation machine 1. Next, the auger 69 is secured to the hydraulic motor 68 by means of pin 74.

The operator now verifies the plumb of auger 69 by means of a conventional level to assure a vertical earthen hole 67 is bored by metal foundation push-it and installation machine 1. Augering guide 62 helps to maintain auger 69 in a vertical position.

Now the operator augers the earthen hole to the required depth by operating hydraulic motor 68 and applying some downward pressure from boom lift 48 upon hydraulic motor 68. When boring is complete, the operator reverses the rotation of hydraulic motor 68 and lifts it, thereby carrying the auger 69 along with it out of earthen hole 67. All of these operations are commanded from control levers 16 or from a remote control box (not shown).

The entire operation is repeated for the second earthen hole 67 required for the second earthen anchor 57. Then auger 69, hydraulic motor 68, and attachment plate assembly 76 can be removed from boom lift 48.

Figure 5:
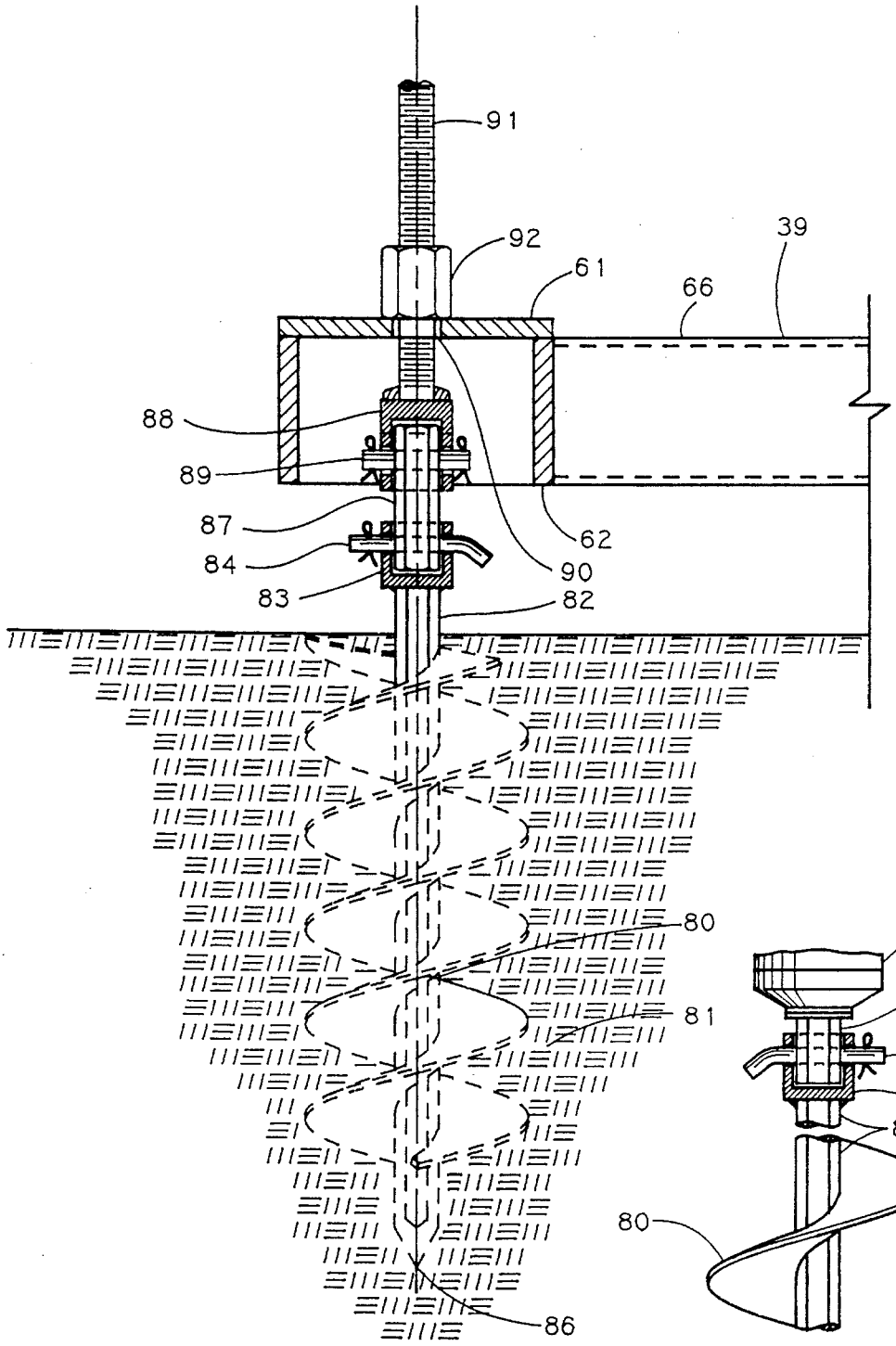
FIG. 5 is an elevation view, partially in section, of an auger utilized in the anchor mode attached to an extendably adjustable uplift resistance assembly.

FIG. 5 is an elevation view, partially in section, of an auger screwed into the soil to be utilized as an earthen anchor. Also shown is a portion of an extendably adjustable uplift resistance assembly, with an augering guide at its end. FIG. 5 shows an uplift resistance plate on the augering guide and a threaded rod through the center of the uplift resistance plate with a hexagonal coupling and a pin attached to one end and showing a nut threaded onto the rod. Also shown is a hexagonal coupling attached to the auger's kelly bar and another pin. Also shown is a short piece of kelly bar with one end inserted into one coupling and its other end inserted into the augers coupling.

Referring now to FIG. 5, the present invention provides auger 80 utilized as earthen anchors. Auger anchors 80 replace earthen anchors 57 for installing certain medium size foundations which can be installed with or without fins. Augers 80 are the type of augers which screw into soils 81 without lifting up earthen spoils, i.e., without boring an earthen hole. Therefore they remain firmly anchored to the soil 81, i.e., firmly screwed into the soil.

Figure 6:
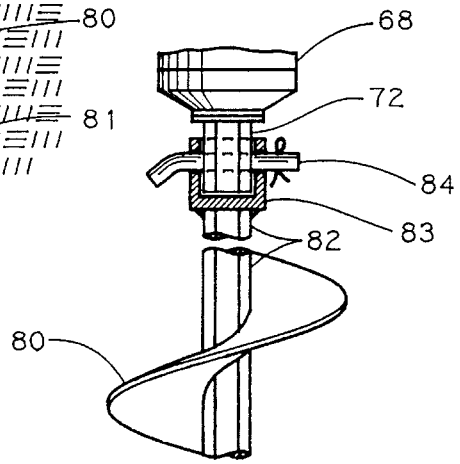
FIG. 6 is an elevation detailed view, partially in section, partially showing a hydraulic motor coupled to an auger anchor.

The operator utilizes the onboard boom lift to attach hydraulic motor 68 (FIG. 6) to kelly bar 82 of auger anchor 80 by means of hexagonal coupling 83 and pin 84. The operator first verifies the plumb of auger anchor 80 and corrects it if required. The operator then proceeds to drive, i.e., to screw auger 80 into the soil by operating hydraulic motor 68 (FIG. 6) by means of control levers 16 or by means of the remote control box.

Conventional auger 80 can be purchased in a plurality of lengths, and they come with hexagonal coupling 83 factory welded to one end of its kelly bar 82. The other end of kelly bar 82, i.e., the end penetrating into soil 81, can be ordered with a sharp point 86 to facilitate the penetration into the soil.

After auger anchor 80 has been screwed into the soil 81, the operator disconnects hydraulic motor 68 (FIG. 6) from the auger's kelly bar 82 by removing pin 84 and lifting the hydraulic motor by means of the onboard boom lift.

Depending on the soil classification from soil test results which are normally available to the operator and depending on the length of the foundation to be installed, the operator determines the length of auger anchor 80 required to be screwed into the soil, one for each uplift resistance assembly 39, to prevent the uplifting of metal foundation push-it and installation machine 1 when pressing the foundation into the soil.

After the auger anchors 80 have been screwed into the soil to the required depth, the hydraulic motor is removed, and kelly bar extension 87 is attached to hexagonal coupling 83 by means of pin 84. Now the operator attaches threaded rod 91 to kelly bar extension 87 by means of hexagonal coupling 88 welded to the threaded rod and pin 89. Then the operator places uplift resistance plate 61 over threaded rod 91 by inserting threaded rod 91 through hole 90, which is in the center of uplift resistance plate 61. Next the operator threads in uplift resistance nut 92 until it is well tightened against uplift resistance plate 61.

In this mode, metal foundation push-it and installation machine 1 is anchored to the soil 81 by means of its two adjustably extendable uplift resistance assemblies 39 and two auger anchors 80, one of each side of the machine.

The operator can proceed now to push the foundation into the soil with respect to the downwardly push from pushing/augering carriage 2 provided by a plurality of hydraulic cylinders exerting their thrust against one or more thrust resistance bars. Thrust exerted by the hydraulic cylinders is exerted first against the bottom plate of a locked-in-place frame locked-in against the thrust resistance bars by means of the frame's locking dog bars. These locking dog bars have the capability of being moved in/out of their locked-in position by means of a mechanism powered by hydraulic means. This mechanism has the capability of being moved up or down by hydraulic means to achieve new locked-in positions at lower levels as the foundation is pushed into the ground. All steps are controlled by an operator from a set of control levers or from a remote control box connected to the apparatus by an umbilical cord.

After the operator has completed pushing the foundation into the soil, the operator removes auger-anchors 80 by reversing their installations process and with the assistance of the onboard boom lift. The operator utilizes the hydraulic motor for unscrewing the auger-anchors after threaded rod 91, uplift resistance nut 92, plate 61, and kelly bar extension 87 are removed. The unscrewing of auger anchors 80 is performed by reversing the rotational direction of the motor's power shaft 72 by means of control levers 16 or by means of the remote control box while shaft 72 is attached to the auger anchor by means of its hexagonal coupling 83 and pin 84.

FIG. 7 is an elevation view, partially in section, of the apparatus of the present invention partially showing its structural tower in the horizontal position Also shown is the tower's hydraulic cylinders and the tower's pivoting plate assembly, safety pin and safety switch. FIG. 2 shows a pushing/augering carriage, mounted on the structural tower and a partial view of a hydraulic motor mounted on the pushing augering carriage together with a flexible power track for bringing hydraulic fluid carrying hoses to the hydraulic motor on the carriage. In addition, it shows the carriage's lower pushing plate, sliding back-plate, and reinforcement plates. FIG. 2 shows a winch with its cable connected to the pushing augering carriage and the winches's hydraulic motor. FIG. 2 shows one of two hydraulic pumps connected to a diesel engine for powering the pumps and several hydraulic control levers and hydraulic fluid carrying hoses. FIG. 2 in addition shows an extendably adjustable uplift resistance assembly with its adjustably extendable sliding arm in its retracted position. Also shown are the truck's front and rear outriggers.

Referring now to FIG. 7 and not previously shown on the preceding Figures, the apparatus's main hydraulic pumps 85 are powered by diesel engine 51 mounted on the front part of truck bed 23. A general overview perspective of the metal foundation push-it and installation machine 1 mounted on a truck is shown in one drawing the apparatus of the present invention and its major components.

Thus it can be seen that the invention accomplishes all of its objectives.

The present invention includes a novel mobile, truck-mounted metal foundation push-it and installation machine for installing prefabricated, longitudinally-finned, cylindrical metal foundations into the ground by pushing the metal foundations through pushing forces provided by hydraulic cylinders mounted on the mobile, truck-mounted metal foundation push-it and installation machine.

The mobile truck-mounted machine can be a tractor trailer flatbed truck, e.g. in one embodiment, or can be a vehicle mounted on rails or tracks.

The present invention includes apparatus and method for providing a novel metal foundation push-it and installation machine which includes a truck-mounted crane and a tower for holding a push-it carriage including metal foundation holder and auger. The novel machine and method of the present invention augers a hole and installs the metal foundation in one step as the push-it carriage is pushed toward the ground.

Hydraulic pushing cylinders push against a bar held in adjustable bar securing positions on the tower, i.e., the hydraulic cylinders push against a bar secured to the side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes a truck-mounted second auger used to drill holes for outboard or satellite anchors or auger anchors to hold down the truck when the foundation is pushed into the ground. The second auger can swing laterally to dig a left or right side outboard or satellite anchor hole. A truck-mounted extensible satellite anchor augering guide and anchor structural support extends and retracts on both sides of the truck.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

Although the invention has been illustrated by the preceding actual examples, it is not to be construed as being limited to the materials or procedures employed therein.

Whereas particular embodiments of the invention have been described in detail hereinabove, for purposes of illustration, it will be evident to those skilled in the art that numerous variations of the details may be made without departing from the invention as defined in the appended claims.

The apparatus and process of the present invention are not limited to the descriptions of specific embodiments presented hereinabove, but rather should be viewed in terms of the claims that follow and equivalents thereof. Further, while the invention has been described in conjunction with several such specific embodiments, it is to be understood that many alternatives, modifications, and variations will be apparent to those skilled in the art in light of the foregoing detailed descriptions. Accordingly, this invention is intended to embrace all such alternatives, modifications, and variations which fall within the spirit and scope of the appended claims.

What is claimed is:

1. A mobile pipe-column-type metal foundation installation apparatus, comprising:

(a.) a mobile platform;

(b.) a pipe-column-type metal foundation holder supported on a tower mounted on said mobile platform, said metal foundation having a cylindrical pipe-column-type body and longitudinal fins welded vertically alongside said cylindrical pipe-column-type body;

(c.) a push-it carriage movably supported on said tower for providing controllably movable positioning to said cylindrical- pipe-column-type metal foundation holder;

(d.) hydraulic pushing cylinders on said push-it carriage for pushing against a header frame held in adjustable securing positions on said tower; and (e.) an auger aligned below said push-it carriage and inside said cylindrical pipe-column-type metal foundation for drilling a hole in the ground in advance of pushing said cylindrical pipe- column-type metal foundation from said metal foundation holder into the ground.

2. A mobile pipe-column-type metal foundation installation apparatus, as set forth in claim 1, wherein said cylindrical pipe-column-type foundation having longitudinal fins welded vertically alongside said cylindrical pipe column body further comprises an integral top plate for mounting a sign, high mast lighting or utility pole, or communication tower.

3. A mobile pipe-column-type metal foundation installation apparatus, as set forth in claim 2, wherein said metal foundation holder further comprises means for holding and securing said metal foundation integral top plate.

4. A mobile pipe-column-type metal foundation installation apparatus, as set forth in claim 3, further comprising:

(f.) outboard satellite anchors to hold down said mobile platform when said cylindrical pipe-column-type metal foundation is pushed into the ground.

5. A mobile pipe-column-type metal foundation installation apparatus, as set forth in claim 4, further comprising:

(g.) a crane mounted on said mobile platform for lifting said cylindrical pipe-column-type metal foundation holder;

(h.) a second auger mounted and detachable to said crane for drilling holes for said outboard satellite anchors, wherein said second auger can swing laterally to dig a left or right side outboard or satellite anchor hole; and (i.) an extensible satellite anchor augering guide and anchor structural support aligned to extend and retract on both sides of said mobile platform.

6. A mobile pipe-column-type metal foundation installation apparatus, as set forth in claim 5, wherein said hydraulic pushing cylinders on said push-it carriage for pushing against a header frame held in adjustable securing positions on said tower further comprise piston rods for pushing against said header frame controllably adjustably held and secured to the side frame of said tower such that after said hydraulic cylinders extend to a maximum extension, said header frame can be advanced to a lower position in the side frame of the tower, further wherein said hydraulic cylinders are adapted to be lowered such that they push against said header frame held in a lower position on said tower.

7. A mobile pipe-column-type metal foundation installation apparatus, as set forth in claim 6, wherein said mobile platform comprises a tractor trailer flatbed and wherein said satellite anchor comprises a cork-screw-type auger anchor or an extendable bottom plate anchor.

8. A method of installing a cylindrical pipe-column-type metal foundation in the ground, comprising:

(a.) providing a mobile platform;

(b.) holding a cylindrical pipe-column-type metal foundation on a tower mounted on said mobile platform, said metal foundation having an integral top plate for mounting a sign, high mast lighting or utility pole, or conmmnication tower on said cylindrical metal foundation and further having longitudinal fins welded vertically alongside said cylindrical pipe column;

(c.) providing controllably movable positioning on said tower to said cylindrical pipe-column-type metal foundation; and (d.) drilling a hole in the ground directly below and inside said cylindrical pipe-column-type metal foundation in advance of pushing said cylindrical pipe-column-type metal foundation into the ground, wherein said drilling and pushing are performed in one step.

9. A method of installing a cylindrical pipe-column-type metal foundation in the ground, as set forth in claim 8, further comprising:

(e.) providing outboard satellite anchors to hold down said mobile platform when said cylindrical pipe-column-type metal foundation is pushed into the ground;

(f.) providing a crane mounted on said mobile platform for lifting said metal foundation and said auger for insertion into said cylindrical pipe-column-type metal foundation holder;

(g.) providing a second auger mounted and detachable to said crane for drilling holes for said outboard satellite anchors, wherein said second auger can swing laterally to dig a left or right side outboard or satellite anchor hole; and (h.) providing an extensible satellite anchor augering guide and anchor structural support aligned to extend and retract on both sides of said mobile platform.

10. A mobile pipe-column-type metal foundation installation apparatus, comprising:

(a.) a mobile tractor trailer flatbed platform and pivoting structural support tower mounted on said flatbed platform;

(b.) a pipe-column-type metal foundation holder supported on said tower mounted on said mobile tractor trailer flatbed platform, wherein said metal foundation comprises a cylindrical pipe-column-type metal foundatien having an integral top plate for mounting a sign, high mast lighting or utility pole, or communication tower and further comprises longitudinal fins welded vertically alongside said cylindrical pipe column, wherein said metal foundation holder further comprises means for holding and securing said metal foundation integral top plate;

(c.) at least one tower-raising hydraulic cylinder for raising and lowering said pivoting structural support tower from said mobile flatbed platform;

(d.) a crane mounted on said flatbed mobile platform for lifting said metal foundation and said auger for insertion into said metal foundation holder on said pivoting structural support tower when extended to a substantially vertical, raised metal foundation installing position;

(e.) a push-it carriage movably supported on said tower for providing controllably movable positioning to said cylindrical-pipe-column-type metal foundation holder on said tower;

(f.) means mounted on said mobile flatbed platform for pushing said metal foundation by at least one foundation installing hydraulic cylinder pushing against a bar held in adjustable bar securing positions on said tower, wherein said foundation installing hydraulic cylinder for pushing against said header frame bar is controllably adjustably held and secured to the side frame of said tower such that as said foundation installing hydraulic cylinder extends to a maximum extension, said header frame bar can be advanced to a lower position in the side frame of the tower;

(g.) an auger on said mobile flatbed platform and aligned below said push-it carriage and inside said cylindrical metal foundation for drilling a hole in the ground in one step in combination with pushing said metal foundation by said metal foundation holder into the ground;

(h.) at least two screw-type outboard satellite anchors for holding down said mobile flatbed platform when said metal foundation is pushed into the ground;

(i.) a second auger on said mobile flatbed platform mounted and detachable to said crane for drilling holes for said outboard satellite anchors, wherein said second auger can swing laterally to dig a left or right side outboard or satellite anchor hole, wherein said satellite anchor comprises a cork-screw-type auger anchor or an extendable bottom plate anchor; and (j.) an extensible satellite anchor augering guide and anchor structural support aligned to extend and retract on both sides of said mobile flatbed platform.

* * * * *